United States Patent [19]

Champion

[11] Patent Number: 4,590,994

[45] Date of Patent: May 27, 1986

[54] HEAT EXCHANGER TUBE STRAINER

[76] Inventor: Elmer L. Champion, P.O. Box 71, Bronte, Tex. 76933

[21] Appl. No.: 641,833

[22] Filed: Aug. 17, 1984

[51] Int. Cl.[4] ..... F28F 19/00

[52] U.S. Cl. ..... 165/119; 210/498; 210/170

[58] Field of Search ..... 165/119, 94, 95; 210/497.01, 498, 170

[56] References Cited

U.S. PATENT DOCUMENTS

| | | | |
|---|---|---|---|
| 231,066 | 8/1880 | Long | 210/497.01 X |
| 2,034,242 | 3/1936 | Mautner | 165/119 X |
| 3,850,813 | 11/1974 | Pall et al. | 210/497.01 X |
| 4,133,768 | 1/1979 | Theriot | 210/497.01 X |
| 4,302,331 | 11/1981 | Condit, Jr. | 210/497.01 X |
| 4,382,465 | 5/1983 | Baron et al. | 165/95 |
| 4,397,349 | 8/1983 | Baron et al. | 165/95 |
| 4,436,633 | 3/1984 | Robinsky et al. | 210/497.01 X |
| 4,489,776 | 12/1984 | Baron | 165/95 |
| 4,517,088 | 5/1985 | Miller | 210/497.01 X |

*Primary Examiner*—Albert W. Davis, Jr.
*Assistant Examiner*—Peggy A. Neils
*Attorney, Agent, or Firm*—Harvey B. Jacobson

[57] ABSTRACT

A strainer assembly is provided for a heat exchanger of the type including at least one heat transfer tube having an inlet end opening outwardly through a tube sheet or tube end plate. The strainer assembly includes an elongated tubular body having first and second end portions and a mid-length outwardly projecting circumferential flange on opposite sides of which the first and second end portions are disposed. The first end portion of the tubular body is open and tightly frictionally telescoped within the inlet end of the heat exchange tube and the second end portion of the body includes an end wall defining spaced apart first openings formed therethrough. The second tubular body end also includes a plurality of circumferentially and longitudinally spaced second openings formed therethrough, the first and second openings being of a predetermined size. Also, the first end portion of the body includes first and second contiguous sections adjacent and remote from the flange, respectively, and the second section is slightly diametrically enlarged relative to the first section and includes circumferentially spaced longitudinal slots opening endwise outwardly through the terminal end of the first end portion. The slots serve to allow slight inward displacement of the portions of the second section defined between adjacent slots and to thereby allow the second section to be tightly frictionally telescoped into the heat exchange tube inlet end.

2 Claims, 4 Drawing Figures

HEAT EXCHANGER TUBE STRAINER

BACKGROUND OF THE INVENTION

Industrial water systems utilizing fresh untreated lake or river water have for some years experienced infestation with an Asiatic clam, Corbicula, to the extent that various portions of the industrial water systems become plugged by clam shells.

Accordingly, a need exists for provision of means by which infestation of industrial water systems by Asiatic claims be controlled, at least to a reasonable extent, and to this end the instant invention comprises a strainer assembly which has been found to be highly effective in controlling clam infestation by clams above a predetermined size.

Examples of various different forms of strainer assemblies including some of the general structural and operational features of the instant invention are disclosed in U.S. Pat. Nos. 317,011, 441,497, 2,229,032, 3,749,250, 4,287,067 and 4,413,675. However, these previously known forms of strainer assemblies are not specifically adapted for use in conjunction with heat exchanger tubes.

BRIEF DESCRIPTION OF THE INVENTION

The strain of the instant invention comprises a cylindrical body including first and second end portions and with the first end portion adapted for frictional telescoping in the inlet end of a heat transfer tube of a heat exchanger. The second end portion of the tubular body includes longitudinally and circumferentially spaced openings of predetermined size as well as a terminal end wall also provided with openings of a predetermined size formed therethrough. The strainer is specifically designed to prevent the intake of Asiatic clams into the inlet end of the associated heat transfer tube. Further, the strainer is constructed in a manner whereby it may be readily removed for cleaning and/or replacement by a new or previously cleaned strainer of the same type.

The main object of this invention is to provide a strainer assembly for use in conjunction with heat exchanger tubes and for the purpose of preventing the entrance of Asiatic clams into the inlet ends of heat transfer tubes.

Another object of this invention is to provide a strainer which may be readily replaced.

Still another object of this invention is to provide a strainer construction which may be readily manufactured of different sizes so as to be adaptable for use in conjunction with heat transfer tubes of varying sizes.

A further important object of this invention is to provide a strainer assembly constructed in a manner whereby the surfaces of the strainer assembly defining the various openings formed therethrough may be readily cleaned.

A final object of this invention to be specifically enumerated herein is to provide a strainer assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
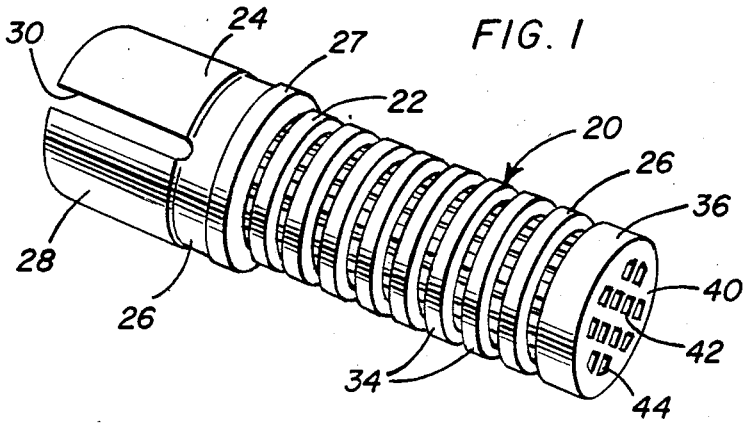
FIG. 1 is a perspective view of the strainer assembly.
Figure 4:
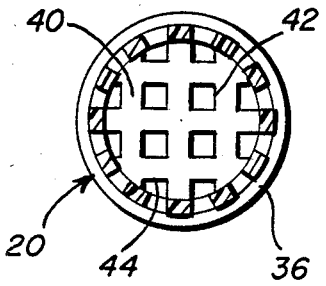
FIG. 4 is a vertical sectional view taken substantially upon the plane indicated by the section line 4—4 of FIG. 3.
Figure 2:
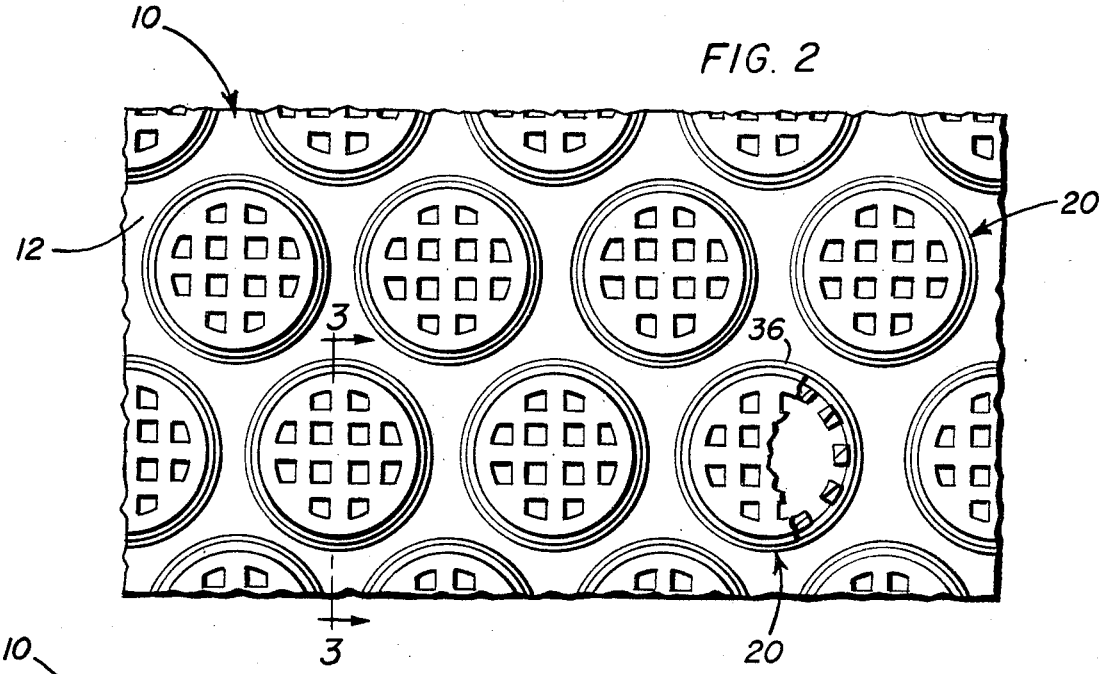
FIG. 2 is a fragmentary elevational view of the tube sheet or tube end plate of a heat exchanger through which the inlet ends of a plurality of heat transfer tubes open and with a plurality of strainer assemblies constructed in accordance with the present invention operatively associated with the heat transfer tube inlet ends.
Figure 3:
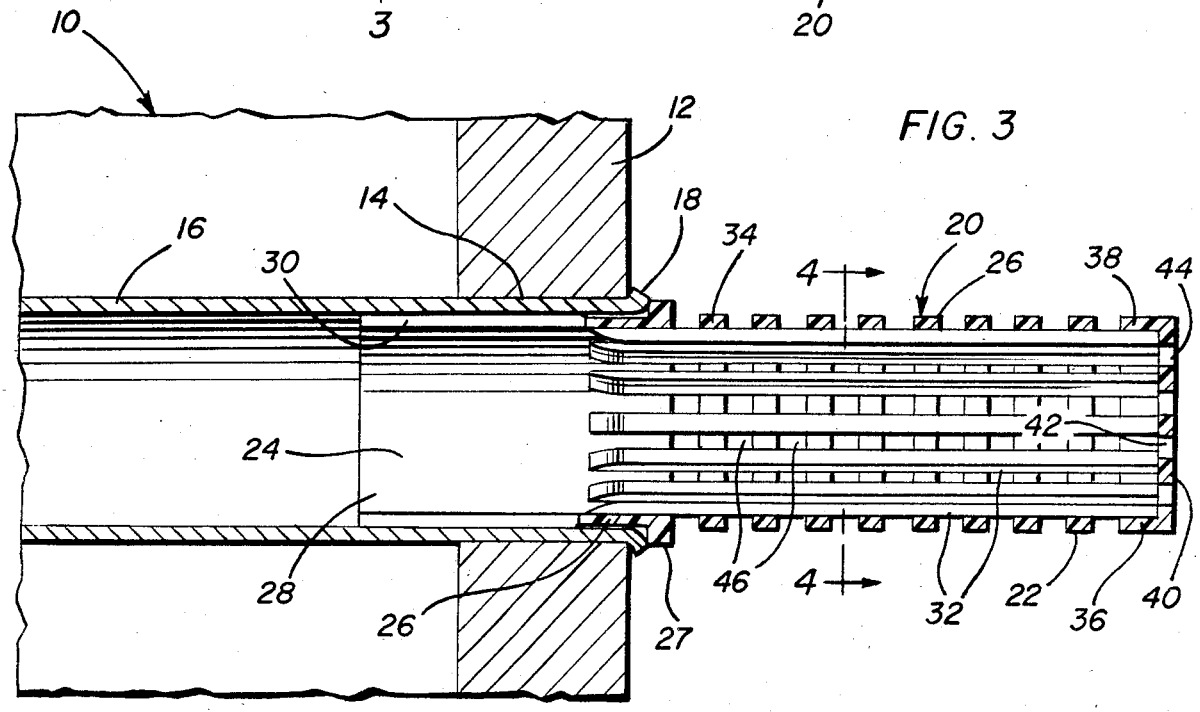
FIG. 3 is an enlarged fragmentary vertical sectional view taken substantially upon the plane indicated by the section line 3—3 of FIG. 2.

Referring now more specifically to the drawings, the numeral 10 generally designates a heat exchanger of generally conventional design including a tube sheet or tube end plate 12 having a plurality of openings 14 formed therethrough. In addition, the heat exchanger 10 includes a plurality of heat exchanger tubes 16 having one set of corresponding flared inlet ends 18 secured through the sheet or plate 12.

The strainer assembly of the instant invention is referred to in general by the reference numeral 20 and comprises a tubular body 22 incorporating first and second end portions 24 and 26 and a mid-length radially outwardly projecting and circumferentially extending flange 27. The first end portion 24 includes first and second contiguous sections 26 and 28 adjacent and remote from the flange 27 and the section 28 is of a diameter slightly greater than the diameter of the section 26. Further, the section 26 includes diametrically opposite longitudinal slots 30 opening endwise outwardly of the terminal end of the first end portion 24.

The second end portion 26 includes a plurality of circumferentially spaced and longitudinally extending bars 32 and a plurality of axially spaced ring sections 34 telescoped over and secured to the bars 32 and axially spaced apart along the length of the second end portion 26. The outer terminal ends of the bars 32 remote from the second end portion 24 are interconnected by a cap member 36 telescoped thereover and including a cylindrical body portion 38 and an end wall 40 closing the outer end of the body portion 38. The end wall 40 includes a plurality of spaced apart openings 42 and 44 formed therethrough and the spaces between adjacent ring sections 34 and bars 32 define openings 46 spaced circumferentially about and longitudinally of the second end portion 26.

The strainer assembly 20 may be fabricated from stainless steel components, or it may be molded of PVC or other plastic.

The second section of the first end portion 24 may be tightly telescopingly received into the inlet end of the tube 16, inasmuch as the wall portions of the first end portion defined between adjacent slots 30 may be slightly inwardly flexed, the stainless steel or plastic of which the strainer assembly is constructed being stiff but somewhat resilient.

The flange 27 may comprise a continuous circumferential flange or individual flange members spaced circumferentially about the tubular body 22.

Inasmuch as the strainer assembly 20 is supported from the corresponding tube 16 by a frictional telescopic of the second section 28 of the first end portion 24 within the inlet end of the tube 16, the strainer assembly 20 may be readily replaced or removed for cleaning whenever desired.

It may be noted from FIG. 1 of the drawings that the slots 30 extend the full length of the second section 28 of the first end portion 24 and slightly into the adjacent portion of the slightly smaller diameter first section 26 of the first end portion 24.

Inasmuch as the ring sections 34 are telescoped over bars 32, the openings 46 including outer portions which open into channels extending about the circumference of the tubular body 22 and inner portions which open into channels defined between adjacent pairs of bars 32 extending longitudinally of the interior of the tubular body 22. Thus, the strainer assembly 20 may be readily cleaned first by moving cleaning elements about the circumferential channels defined between adjacent ring sections 34 and thereafter moving cleaning elements longitudinally of the channels defined between adjacent bars 32.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a heat exchanger of the type including at least one heat transfer tube having an inlet end opening outwardly through a tube sheet or tube end plate, a strainer assembly for preventing the intake of soolid and semi-solid material of a size greater than a predetermined maximum into said inlet end, said strainer assembly including an elongated tubular body having first and second end portions and mid-length outwardly projecting flange means on opposite sides of which said end portions are disposed, said first end portion being telescoped into said inlet end with said flange means abutted against portions of said heat exchanger disposed about the terminal end of said inlet end, said first end portion being open and frictionally telescoped within said inlet end, said second end portion including an end wall, said end wall defining spaced apart first openings formed therethrough of a size smaller than said predetermined maximum size and said second end portion defining a plurality of circumferentially and longitudinally spaced second openings formed therethrough also of a size smaller than said predetermined size, said first end portion including first and second contiguous sections adjacent and remove from said flange means, said second section being slightly diametrically enlarged relative to said first section and including circumferentially spaced longitudinal slots formed therein opening endwise outwardly through the terminal end of said first end portion, said longitudinal slots serving to allow slight inward radial displacement of the portions of said second section defined between adjacent slots and to thereby allow said second section to be tightly frictionally telescoped into said inlet end, said second end portion including a plurality of parallel, circumferentially spaced and longitudinally extending bars with the ends of said bars remote from said end wall lengthwise overlapping and anchored relative to the inner surfaces of said first section, a cylindrical body portion telescoped over and anchored relative to the outer surfaces of the terminal ends of said bars remove from said first section, said second end portion also including a plurality of axially spaced ring sections telescoped over and secured to the outer surfaces of said bars intermediate said first section and cylindrical body portion, whereby circumferentially and longitudinally spaced generally radial openings are defined in said second end portion between adjacent bars and adjacent ring sections, the outer portions of said radial openings into circumferentially extending and outwardly opening channels defined between adjacent ring sections and the inner portions of said radial openings open into longitudinally extending channels defined between pairs of circumferentially adjacent bars, said end wall extending across the end of said cylindrical body portion remote from said first section.

2. The strainer assembly of claim 1 wherein said flange means comprises a peripherally continuous flange extending about said first end portion.

* * * * *